US005437414A

United States Patent [19]

Hall

[11] Patent Number: 5,437,414

[45] Date of Patent: Aug. 1, 1995

[54] RECIRCULATING SHREDDER

[76] Inventor: John L. Hall, 8444 Julie Lynne Cir., Tracy, Calif. 95376

[21] Appl. No.: 265,829

[22] Filed: Jun. 27, 1994

[51] Int. Cl.[6] ..... B02C 18/22; B02C 18/40

[52] U.S. Cl. ..... 241/74; 241/79.3; 241/222; 241/606

[58] Field of Search ..... 241/74, 79.3, 100, 222, 241/236, 606, DIG. 38

[56] References Cited

U.S. PATENT DOCUMENTS

| | | | |
|---|---|---|---|
| 2,731,208 | 1/1956 | Dodd | 241/41 |
| 3,589,276 | 6/1971 | Swallert | 100/90 |
| 3,931,935 | 1/1976 | Holman | 241/24 |
| 4,201,128 | 5/1980 | Whitehead et al. | 100/45 |
| 4,211,133 | 7/1980 | Muth | 83/162 |
| 4,618,103 | 10/1986 | Wilson et al. | 441/41 |
| 4,809,915 | 3/1989 | Koffsky et al. | 241/36 |
| 4,824,028 | 4/1989 | Rota | 241/24 |
| 5,089,228 | 2/1992 | Meijer | 422/37 |
| 5,114,084 | 5/1992 | Yamaguchi et al. | 241/178 |
| 5,205,495 | 4/1993 | Garnier | 241/31 |
| 5,294,412 | 3/1994 | Orlando | 422/295 |

*Primary Examiner*—John Husar

*Attorney, Agent, or Firm*—Harris Zimmerman

[57] ABSTRACT

Apparatus for fragmentizing objects recovers and reprocesses oversized fragments. A shredder is encircled by an annular trommel revolving about a horizontal axis of rotation and which extends over the shredder intake hopper and below the fragment outlet. Fragments which are too large to pass through apertures in the trommel are carried upward by vanes on the trommel and returned to the intake hopper. In one form of the apparatus, a fragment guide has a curved surface extending along at least a lower portion of the trommel and which is spaced from the trommel to allow small fragments to pass through the trommel apertures. Cleats on the trommel urge such fragments towards a fragment discharging end of the guide. Thin elongated fragments which attempt to pass through a trommel aperture are stopped by the presence of the guide and thus are also carried upward and returned to the intake for further processing.

8 Claims, 3 Drawing Sheets

RECIRCULATING SHREDDER

TECHNICAL FIELD

This invention relates to motor driven apparatus for shredding or fragmentizing objects.

BACKGROUND OF THE INVENTION

A conventional shredding machine may produce fragments of the feedstock which have different sizes. Fragment size is influenced by the size, shape and composition of components of the feedstock among other factors. The effect is most pronounced in instances where the feedstock includes components of greatly differing sizes, shapes and physical properties. The presence of relatively large fragments in the output of a shredder to some extent defeats the purpose of the shredding operation and in certain cases can have adverse effects on the further processing of the shredded material. The processing of infectious medical wastes, such as are generated at hospitals, medical clinics and the like is one example.

Infectious medical wastes may include used bandages and tissues, hypodermic needles, specimen containers, hard metal prostheses and diverse other objects and materials. Such wastes must be sterilized prior to disposal of the waste at a landfill, garbage dump or the like and it is advantageous if the waste is shredded following sterilization. Thorough shredding enables greater compaction of the waste and thereby reduces hauling costs and space requirements at the dump site. Potentially hazardous sharp objects in the waste are reduced to fragments. The shredded condition makes it apparent to handlers that the waste has been processed and rendered harmless and also makes it unrecognizable as medical waste by casual observers who might otherwise be needlessly apprehensive upon encountering such wastes. The presence of large fragments in the processed waste detracts from full realization of these objectives. A thin hypodermic needle, for example, can pass intact through a conventional shredder if it enters the mechanism at certain points in an end forward orientation.

The present invention is directed to overcoming one or more of the problems discussed above.

SUMMARY OF THE INVENTION

In one aspect of the present invention, shredding apparatus includes a shredder and a revolvable annular trommel which has an array of apertures. The trommel extends under the shredder outlet and over the shredder intake in position to intercept released fragments which are too large to pass through the apertures. A motor revolves the trommel thereby causing the intercepted fragments to be returned to the shredder intake.

In another aspect of the invention, the apertures are situated in a cylindrical screen portion of the trommel and a fragment guide is disposed adjacent the trommel. The guide has a curved surface which faces the screen portion of the trommel and which has a curvature conforming with the screen portion, the curved surface being spaced from the screen portion to provide a gap therebetween. The guide has an edge at one side of the trommel over which fragments that have passed completely through one of the trommel apertures are discharged. The guide extends from the edge around the bottom of the trommel and up along at least a portion of the opposite side of the trommel. Thus elongated pieces of material which are sufficiently thin to enter the trommel apertures and which have a length exceeding the thickness of the gap are prevented from passing completely through the apertures by the guide and are returned to the shredder intake by the motion of the trommel.

In still another aspect of the invention, shredding apparatus for reducing objects to fragments includes a shredder having a housing with an intake opening, means for fragmentizing objects within the housing and an outlet opening at which fragments are released. An annular trommel encircles the shredder and is revolvable about a horizontal axis of rotation, the trommel being positioned to extend under the shredder outlet opening and over the shredder intake opening. The trommel has an apertured cylindrical screen region and spaced apart vanes secured to the inner surface of the screen region at angular intervals therearound. An intake hopper is disposed above the intake opening of the shredder housing and below the uppermost region of the trommel. Motor means revolve the trommel. Fragments that are too large to pass through the trommel apertures are trapped by the screen portion of the trommel and are carried upward by the vanes and then drop into the hopper for reprocessing by the shredder.

The invention provides shredding apparatus which intercepts and re-shreds output fragments having sizes that exceed a desired maximum fragment size. In one form of the invention, the apparatus also intercepts and reprocesses thin elongated pieces of material that exceed a particular length. This realizes a more complete shredding of objects including feedstocks such as medical waste which may contain objects of diverse different sizes, shapes and physical properties.

The invention, together with further aspects and advantages thereof, may be further understood by reference to the following description of the preferred embodiment and by reference to the accompanying drawings.

DETAILED DESCRIPTION OF THE PREFERRED EMBODIMENT

Figure 1:
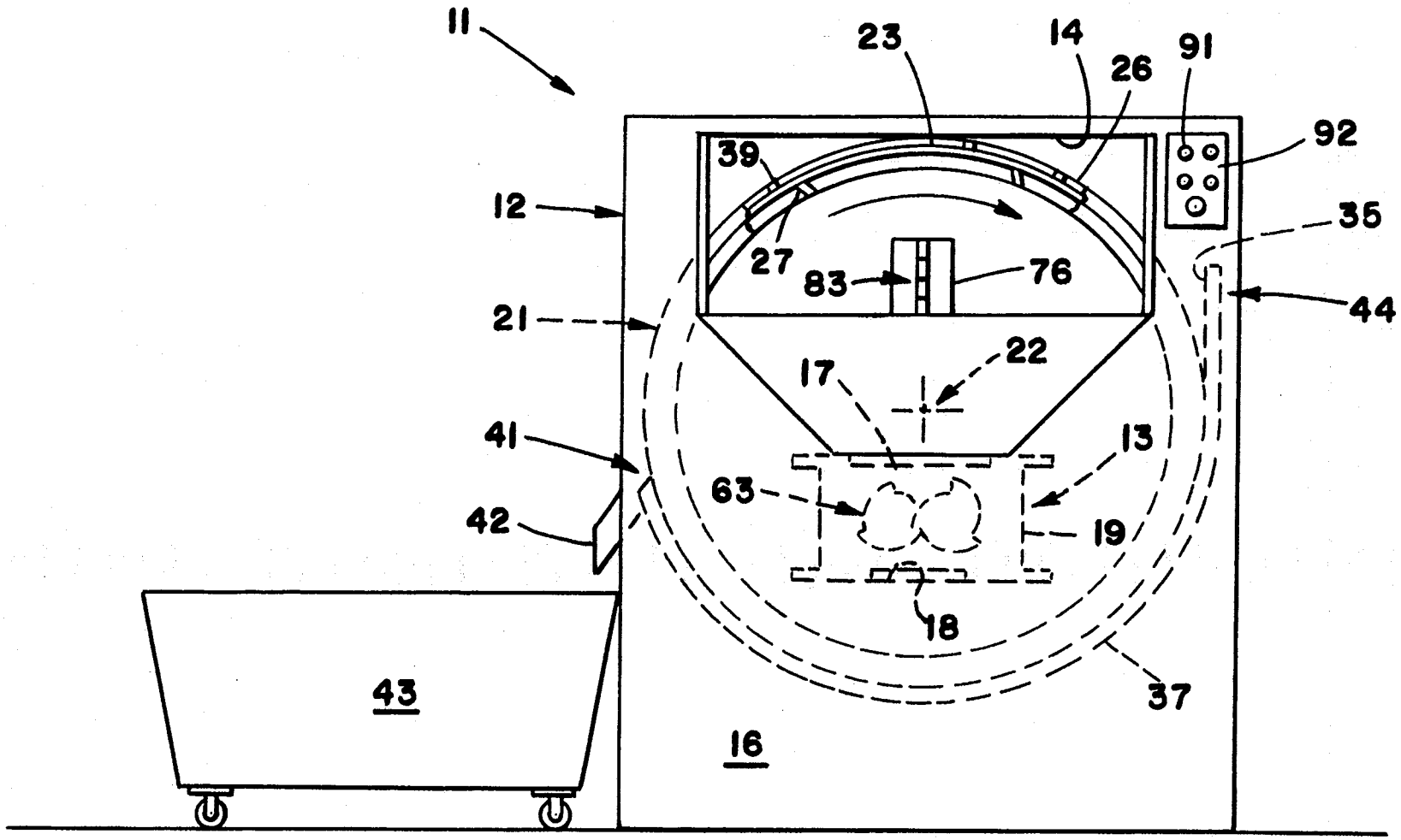
FIG. 1 is a front elevation view of shredding apparatus embodying the invention.

Referring initially to FIG. 1 of the drawings, the shredding apparatus 11 of this embodiment of the invention has an outer housing 12 in which a shredder 13 is disposed at an elevated location. An opening 14 in the front wall 16 of housing 12 enables entry of objects which are to be shredded, such as plastic bags containing medical wastes for example, into the intake opening 17 of the shredder 13. Fragments of the shredded objects are released through an outlet opening 18 at the underside of the shredder housing 19.

Fragments in the discharged material which are larger than a particular size are intercepted and returned to the shredder intake opening 17 for reprocessing. For this purpose, the shredder 13 is encircled by an annular trommel 21 which extends under the shredder outlet opening 18 and over the intake opening 17. Trommel 21 revolves about a horizontal axis of revolution located at the geometrical center 22 of the trommel.

Figure 2:
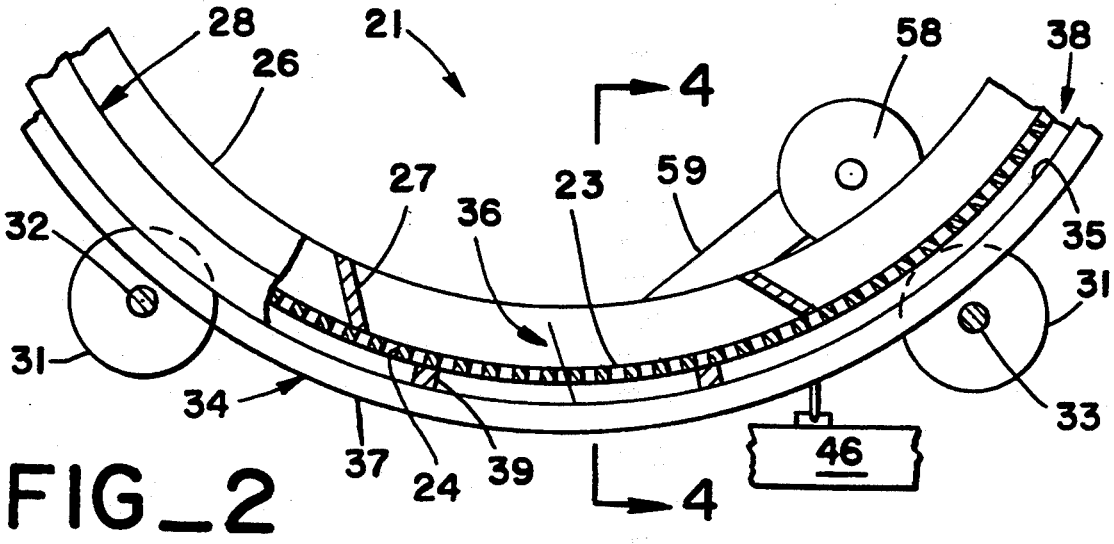
FIG. 2 is a broken out elevation view of the lower region of a trommel and adjacent elements which are components of the shredding apparatus.
Figure 3:
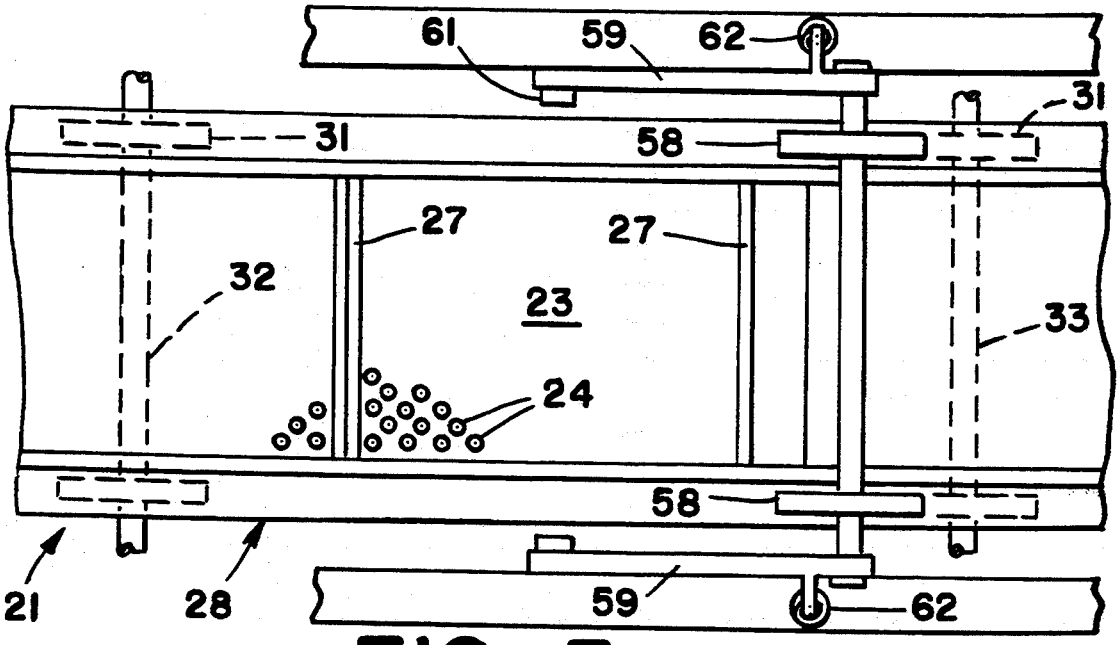
FIG. 3 is a top view of the structure depicted in FIG. 2.
Figure 4:
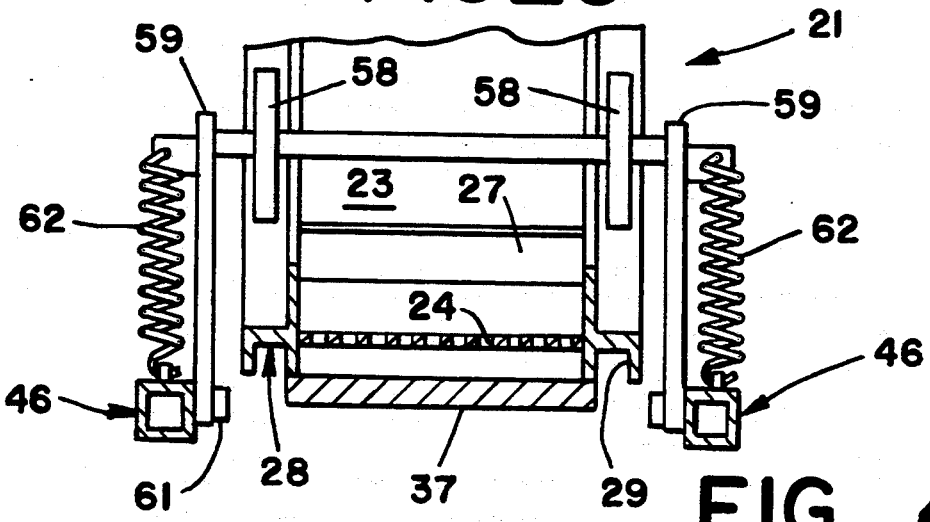
FIG. 4 is a cross section view taken along line 4—4 of FIG. 2.

Referring jointly to FIGS. 2, 3 and 4, the trommel 21 has a cylindrical screen portion 23 which forms an array of apertures 24 that extends around the entire circumference of the trommel. The diameter of the apertures 24 determines the maximum size of the fragments that will be discharged from the shredding apparatus. Fragments having the maximum size or a smaller size fall through the apertures 24 while larger fragments are retained on the screen portion 23. Annular end walls 26 on the trommel 21 extend from the ends of the screen portion 23 towards the axis of rotation of the trommel for a short distance and also extend outward in the opposite direction for a short distance. Oversized fragments that have been intercepted by the trommel 21 are carried upward for return to the shredder 13 by a series of vanes 27 at the inside surface of screen portion 23 that extend between the end walls 23 at spaced apart locations around the screen portion. Vanes 27 are preferably inclined relative to the adjacent portion of the screen portion 23 and lean into the direction of travel of the trommel 21 as this causes the vanes to carry fragments to a higher location than is otherwise the case.

The trommel end walls 26 have angled flanges 28 which form an annular groove 29 at each end of the trommel 21 which grooves extend around the circumference of the trommel and which face away from the axis of rotation. The trommel 21 is supported and turned by support wheels 31 having rims which extend into the grooves 29. A first pair of the wheels 31 are mounted on a drive shaft 32 and are situated at the underside of the trommel 21 at a location which is offset from the lowermost portion of the trommel. A second pair of the wheels 31 are mounted on a second parallel shaft 33 and are at the underside of the trommel at a location which is offset from the lowermost portion in the opposite direction.

In some shredding operations, small fragments which pass through the apertures 24 may simply be allowed to drop into a receptacle or a conveyer situated below the trommel. In other operations, such as in the processing of medical wastes, it is preferable to provide means 34 for preventing complete passage of elongated thin pieces of material through the apertures and for returning such objects to the shredder intake.

Entrapment of thin elongated objects, such as the hypodermic needle 36 shown in FIG. 2, is provided for by a fragment guide 37 which has a curved inner surface 35 that conforms with the curvature of trommel screen portion 23. Referring again to FIGS. 2, 3 and 4 in conjunction, surface 35 spans the rims of the trommel end walls 26 and thus is spaced from the screen portion 23 to form an arcuate gap 38 in which fragments which pass through the trommel are intercepted. A series of cleats 39 are secured to the trommel 21 and extend between the end walls 26 at spaced apart locations around the circumference of the trommel. The motion of the trommel 21 causes the cleats to sweep the intercepted fragments upward along gap 38 in the direction of travel of the trommel.

Referring again to FIG. 1, guide 37 extends around the bottom region of trommel 31 and upward for a distance along each side of the trommel. The guide has a discharge end edge 41 located below the elevation of the center 22 of trommel 21. A downwardly inclined chute 42 receives the fragments which are released over edge 41 and extends out of outer housing 12 to deliver the fragments to a receptacle such as a cart 43 or a conveyer or the like.

The opposite end 44 of guide 37 preferably extends above the level of the center of trommel 21 and the inner surface 35 of the guide departs from the end walls 26 of the trommel and becomes increasing more distant from the trommel screen portion 23 as the end 44 of the guide is approached. This causes the end 44 of guide 37 to function as a scoop for recovering any fragments that may not have been released over the opposite end 41 of the guide and which may have traveled over the top of the shredder 13 on the trommel.

Referring again to FIG. 2, thin elongated objects such as needle 36 which drop from the shredder do not pass completely through a trommel aperture 24 if the length of the object exceeds the distance between the inner surfaces of screen 23 and guide 37. Passage is blocked by abutment of the lower end of the elongated object 36 against the guide 37. Referring jointly to FIGS. 1 and 2, the object 36 is then dragged towards the discharge end 41 of the guide 37 by the rotary motion of trommel 21. Unlike the fragments which have passed completely through a trommel aperture 24, the thin elongated objects 36 are not released at the discharge end 41 of guide 37 and are carried up and over the shredder 13 and dropped into the shredder for further processing.

In order to bring this effect about, the discharge end 41 of guide 37 is located well up along the side of the trommel 21 at a location which is just a short distance below the elevation of the center of the trommel. End 41 may, for example, be at the location where a hypothetical line extending from end 41 to the axis of rotation 22 of the trommel forms an angle of about 15° with a hypothetical line that extends horizontally from the axis of rotation. As the elongated object 36 is dragged towards the end 41 of the guide, it is also being turned into an increasingly more horizontal orientation. In the region of end 41, the elongated object 36 is in a cantilevered relationship with the trommel 21. Gravitational force pulls down on the portions of the object 36 that are outside of the trommel aperture 24 in a manner which creates frictional resistance to withdrawal of the object from the aperture. Consequently it is carried on upward and over shredder 13. The orientation of the object 36 becomes increasingly more vertical at this stage of trommel rotation. Consequently, the gravitationally induced resistance to release of the object 36 diminishes and the object drops out of the aperture 24 and into the shredder 13 for further shredding.

Figure 5:
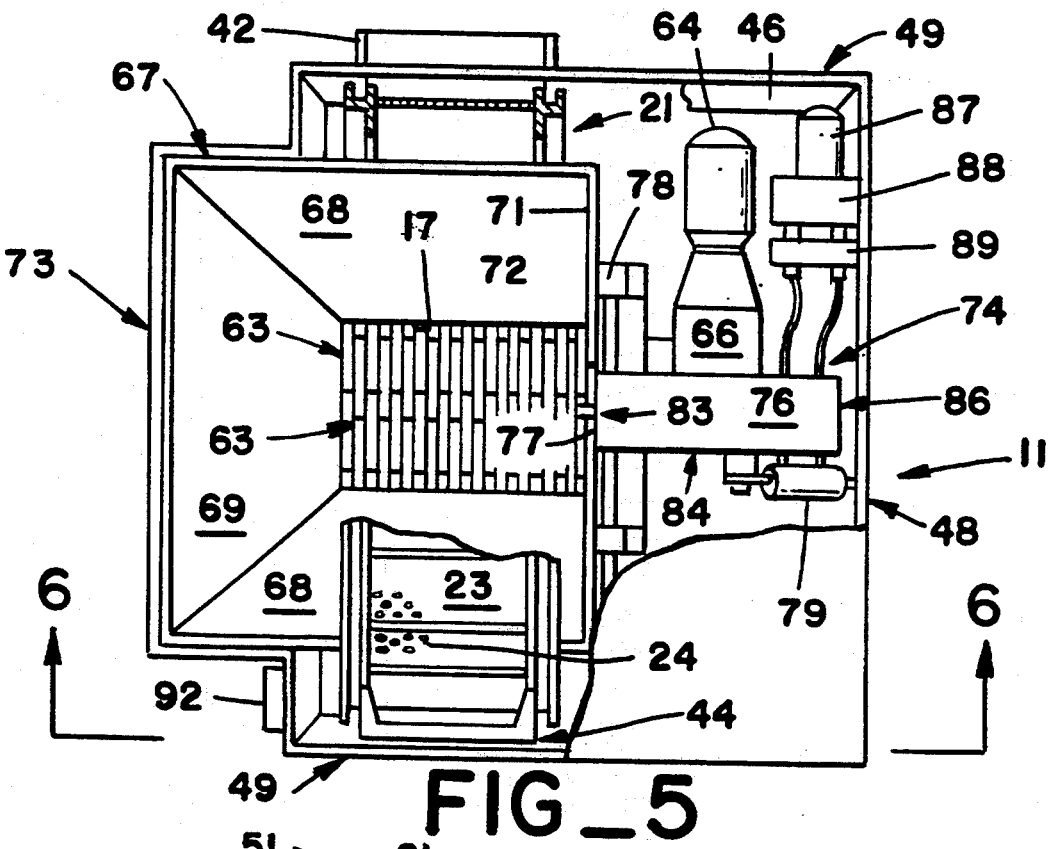
FIG. 5 is a broken out top view of the shredding apparatus.
Figure 6:
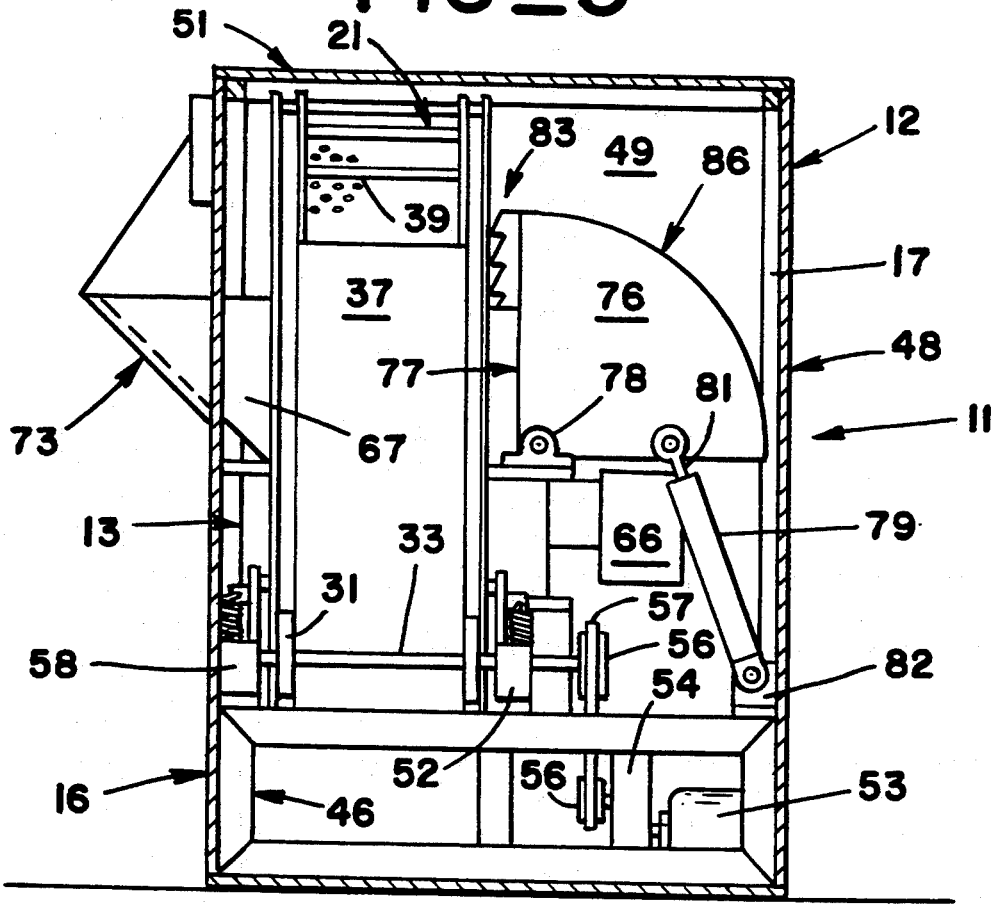
FIG. 6 is a sectional side view of the shredding apparatus taken along line 6—6 of FIG. 5.

Considering the construction of this example of the invention in further detail, with reference jointly to FIGS. 5 and 6, a heavy rectangular framework 46 within the bottom region of outer housing 12 supports the shredder 13 and trommel 21. Lighter frame members 47 extend upward to support the front wall panel 16, back wall panel 48, side wall panels 49 and top panel 51 of the housing 12. The previously described shafts 32 and 33 on which trommel support wheels 31 are mounted are supported by bearings 52 which are secured to the heavy framework 46. An electrical motor 53 is coupled to the one trommel drive shaft 33 through a speed reducing gearbox 54 and pulleys 56 which are coupled by a V-belt 57.

Referring again to FIGS. 2, 3 and 4, it is preferable to provide a pair of pinch wheels 58 to assure that rotation of the driving wheels 31 is transferred to trommel 21 without slippage. Pinch wheels 58 are situated at the uppermost ends of pivot arms 59 and bear against the upper surfaces of the trommel flanges 28 over the locations of the trommel drive wheels 31. The lowermost ends of arms 59 are pivoted to framework 46 by pivot pins 61 which enable pivoting movement of the arms in the upward and downward directions. Tension springs 62 connected between the arms 59 and framework 46 urge the pinch wheels against trommel flanges 28 thereby increasing the frictional coupling of drive wheels 31 to the trommel 21.

Referring jointly to FIGS. 1, 5 and 6, the shredder 13 may be of any of the known designs which variously cut, grind, pulverize or otherwise convert feedstock into fragments of the original material. In the present example, the shredder 13 is of the known type which has two parallel columns of counter-rotating, interleaved cutter disks 63 that have teeth which bite small chunks out of objects that are fed into the shredder. An electrical motor 64 and speed reducing gearbox 66 are secured to the back of the shredder housing 19 to drive the disks 63. An intake hopper 67 is situated above shredder 13 to receive objects that are to be shredded and has sloping side walls 68 and a sloping front wall 69 which jointly guide such objects to the shredder intake opening 17. The rear wall 71 of the hopper 67 extends vertically and has a vertically extending slot 72 at its center for purposes which will hereinafter be described.

The front end of the intake hopper 67 preferably extends out of the interior of the housing 12 below the opening 14 in housing front wall 16 though which material to be shredded is received as this facilitates the process of depositing material in the shredding apparatus 11. The region 73 of housing front wall 16 that is in front of the hopper 67 extends outward from other regions of the front wall and is shaped to conform with the front end of the hopper.

Objects which arrive at the intake opening 17 of shredder 13 are drawn down towards the cutter disks 63 by gravity but in some cases this may not result in a desirably rapid feeding of material to the disks. Some kinds of materials may tend to ride on the top of the cutter disks 63. In feeding of objects at the optimum rate can be assured by providing ram means 74 for forcing material into the shredder intake opening 17. In this example, the ram means 74 includes a ramming member 76 having a flat ramming surface 77 which can be caused to press down on objects which are situated at the intake opening 17. Pivot couplings 78 at one end of the ramming surface 77 couple member 76 to the shredder housing 19 and enable pivoting of the member between one position at which ramming surface 77 extends in a substantially parallel relationship with intake opening 17 in proximity to the opening and another position at which the surface extends away from the opening and extends vertically within the slot 72 in the rear wall 71 of hopper 67. Pivoting of the member 76 is effected by a hydraulic ram 79 of the known type which has an extendible and retractable rod 81. Ram 79 is pivoted to a bracket 82 which is secured to framework 46 below the ramming member 76 and the rod 81 of the ram is pivoted to the member at a location which is spaced rearwardly from shredder 13.

Teeth 83, arranged in a linear column, extend from the ramming surface 77 at a centered location on the surface at which the teeth are equidistant from the two columns of cutter disks 63 when the surface is pivoted into parallel relationship with the shredder intake opening 17. The teeth 83 prevent objects from sliding out from under the ramming surface 77 and also aid in forcing material down between the cutter disks 63.

The ramming member 76 is preferably provided with side walls 84 and a curved end wall 86 which extend away from the ramming surface 77 and which have configurations that jointly cause the member as a whole to have the shape of a quarter sector of a cylinder. This assures that the member 76 will not lift objects out of hopper 67 as it pivots away from intake opening 17.

Another electric motor 87 within housing 12 drives a pump 88 for supplying pressurized hydraulic fluid to a solenoid piloted valve 89 which controls the hydraulic ram 79. The valve 89, shredder motor 64 and trommel drive motor 53 may have manual control switches 91 situated at a control panel 92 at the front wall of housing 12 or cycling of the shredding apparatus 11 may be microprocessor controlled in response to timers and sensors. Ram 79, for example, may be automatically cycled in response to sensed low current flow to the shredder motor 64 which condition indicates that the load on the motor is low due to insufficient input to the shredder 13. If shredder motor current does not rise in response to cycling of the ram 79, further cycling of the ram may be delayed for a period of time as this indicates an absence of feedstock in hopper 67.

The invention has been described in connection with the shredding of medical wastes but may also be used to shred diverse other materials particularly where it is desirable to limit the maximum size of fragments of the feedstock to a particular maximum size.

While the invention has been described with reference to one particular embodiment for purposes of example, many modifications and variations of the construction are possible and it is not intended to limit the invention except as defined in the following claims.

I claim:

1. Shredding apparatus having a shredder with an intake for receiving materials that are to be fragmentized and an outlet at which the fragments are released from the shredder, further comprising:

a revolvable annular trommel having an array of apertures therein and wherein said trommel extends under said outlet and over said intake in position to intercept released fragments which are too large to pass through the apertures, wherein said trommel has an inside surface at which the intercepted fragments are collected, further including a plurality of spaced apart vanes secured to said trommel at said inside surface thereof which vanes extend away from said inside surface within said trommel and wherein each of said vanes is angled relative to the adjacent portion of said inside surface of said trommel and extends in the direction of rotation of said trommel, and a motor coupled to said trommel to revolve said trommel whereby the intercepted fragments are returned to said shredder intake.

2. The apparatus of claim 1 wherein said trommel has a cylindrical screen portion in which said apertures are situated and which forms said inside surface and has a pair of annular end walls which extend inward from said screen portion towards the axis of rotation of said trommel and wherein said vanes extend between said end walls and contact each thereof.

3. Shredding apparatus having a shredder with an intake for receiving materials that are to be fragmentized and an outlet at which the fragments are released from the shredder, and wherein said shredder has a housing and wherein said intake for receiving materials includes an opening in said housing, said apparatus being further comprised of:

a revolvable annular trommel having an array of apertures therein and wherein said trommel extends under said outlet and over said intake in position to intercept released fragments which are too large to pass through the apertures, a motor coupled to said trommel to revolve said trommel whereby the intercepted fragments are returned to said shredder intake, further including ram means for forcing material into said opening wherein said ram means includes a ram member having a ramming surface, said ram being pivoted to said apparatus for movement between one position at which said ramming surface extends in substantially parallel relationship with said opening in proximity thereto and another position at which said ramming surface extends away from said opening, and motor means for pivoting said ram member towards said one position and away therefrom.

4. The apparatus of claim 3 further including a plurality of teeth secured to said ram member and which extend outward from said ramming surface thereof.

5. The apparatus of claim 4 wherein said teeth are aligned in a linear row which extends in orthogonal relationship with the pivot axis of said ram member.

6. The apparatus of claim 3 wherein said ram member pivots about a horizontal pivot axis situated at one end of said trommel and has a first end which is closest to said pivot axis and a second end that is remote therefrom and wherein said ram member has opposite side walls which extend upward from said ramming surface when said ram member is at said one position thereof and a curved end wall which extends between said side walls and which slopes continuously in a downward direction towards said second end of said ram member when said ram member is at said one position thereof.

7. Shredding apparatus having a shredder with an intake for receiving materials that are to be fragmentized and an outlet at which the fragments are released from the shredder wherein said apparatus further comprises:

a revolvable annular trommel having an array of apertures therein and wherein said trommel extends under said outlet and over said intake in position to intercept released fragments which are too large to pass through the apertures, wherein said trommel has a cylindrical screen portion in which said apertures are situated and wherein said trommel has an annular outward extending lip at each end of said cylindrical screen portion, a fragment guide disposed adjacent said lips of said trommel and having a curved surface which has a curvature conforming to the curvature of said screen portion and which is spaced apart from said screen portion to provide a gap between said screen portion and said curved surface, said fragment guide having an edge at one side of said trommel over which fragments that have passed completely through one of said apertures are discharged and wherein said guide extends from said edge around the bottom of said trommel and up along at least a portion of the opposite side of said trommel whereby elongated pieces of material which are sufficiently thin to enter said apertures and which have a length exceeding the thickness of said gap are prevented from passing completely through said apertures and are returned to said intake by the motion of said trommel, further including a plurality of spaced apart cleats disposed in said gap and being secured to said trommel for movement therewith and wherein each of said cleats extends from one of said lips to the other thereof, and a motor coupled to said trommel to revolve said trommel whereby the intercepted fragments are returned to said shredder intake.

8. Shredding apparatus having a shredder with an intake for receiving materials that are to be fragmentized and an outlet at which the fragments are released from the shredder wherein said apparatus further comprises:

a revolvable annular trommel having a cylindrical screen portion and an array of apertures therein and wherein said trommel extends under said outlet and over said intake in position to intercept released fragments which are too large to pass through the apertures, and a motor coupled to said trommel to revolve said trommel whereby the intercepted fragments are returned to said shredder intake, a fragment guide disposed adjacent said trommel and having a curved surface which has a curvature conforming to the curvature of said screen portion and which is spaced apart from said screen portion to .provide a gap between said screen portion and said curved surface, said fragment guide having an edge at one side of said trommel over which fragments that have passed completely through one of said apertures are discharged and wherein said guide extends from said edge around the bottom of said trommel and up along at least a portion of the opposite side of said trommel whereby elongated pieces of material which are sufficiently thin to enter said apertures and which have a length exceeding the thickness of said gap are prevented from passing completely through said apertures and are returned to said intake by the motion of said trommel, wherein the spacing of said curved surface of said fragment guide from said cylindrical screen portion of said trommel becomes progressively greater in the upward direction at a location on said opposite side of said trommel that is above the axis of rotation of said trommel.

* * * * *